US005377881A

United States Patent [19]

Jouillat

[11] Patent Number: 5,377,881

[45] Date of Patent: Jan. 3, 1995

[54] FLUID PUMP WITH SECURE MOUNTING TO RECEPTACLE STOPPER

[75] Inventor: Claude Jouillat, Montigny-Sur-Avre, France

[73] Assignee: Société Technique de Pulvérisation S.T.E.P., Verneuil-Sur-Avre, France

[21] Appl. No.: 102,261

[22] Filed: Aug. 5, 1993

[30] Foreign Application Priority Data

Aug. 10, 1992 [FR] France ..... 92 09881

[51] Int. Cl.[6] ..... B65D 88/54

[52] U.S. Cl. ..... 222/321; 222/385

[58] Field of Search ..... 222/383, 385, 321, 402.1; 285/382, 921

[56] References Cited

U.S. PATENT DOCUMENTS 5,033,655 7/1991 Brown ..... 285/382 X

FOREIGN PATENT DOCUMENTS 0307310 3/1989 European Pat. Off. .

0340332 11/1989 European Pat. Off. .

0453357 10/1991 European Pat. Off. .

9204129 3/1992 WIPO .

*Primary Examiner*—Gregory L. Huson

*Attorney, Agent, or Firm*—Sughrue, Mion, Zinn, Macpeak and Seas

[57] ABSTRACT

A fluid substance dispenser includes a pump mounted on a stopper 20 designed to be fixed on a neck of a receptacle. The pump includes a body 1, a piston 2 that slides axially inside the pump body, a return spring 10 that urges the piston towards the open end of the body, and a single piece ferrule 11 fixed in the open end of the pump body to limit motion of the piston towards the second end. The ferrule has a flange 11*a* which extends radially outwards, and is engaged as a force-fit inside an internal passage 28 of the stopper to hold the pump in the stopper, preventing the pump body from moving towards the outside of the receptacle. The ferrule is made of a harder plastics material than the stopper so that the radial flange bites into the stopper.

5 Claims, 5 Drawing Sheets

FIG.4
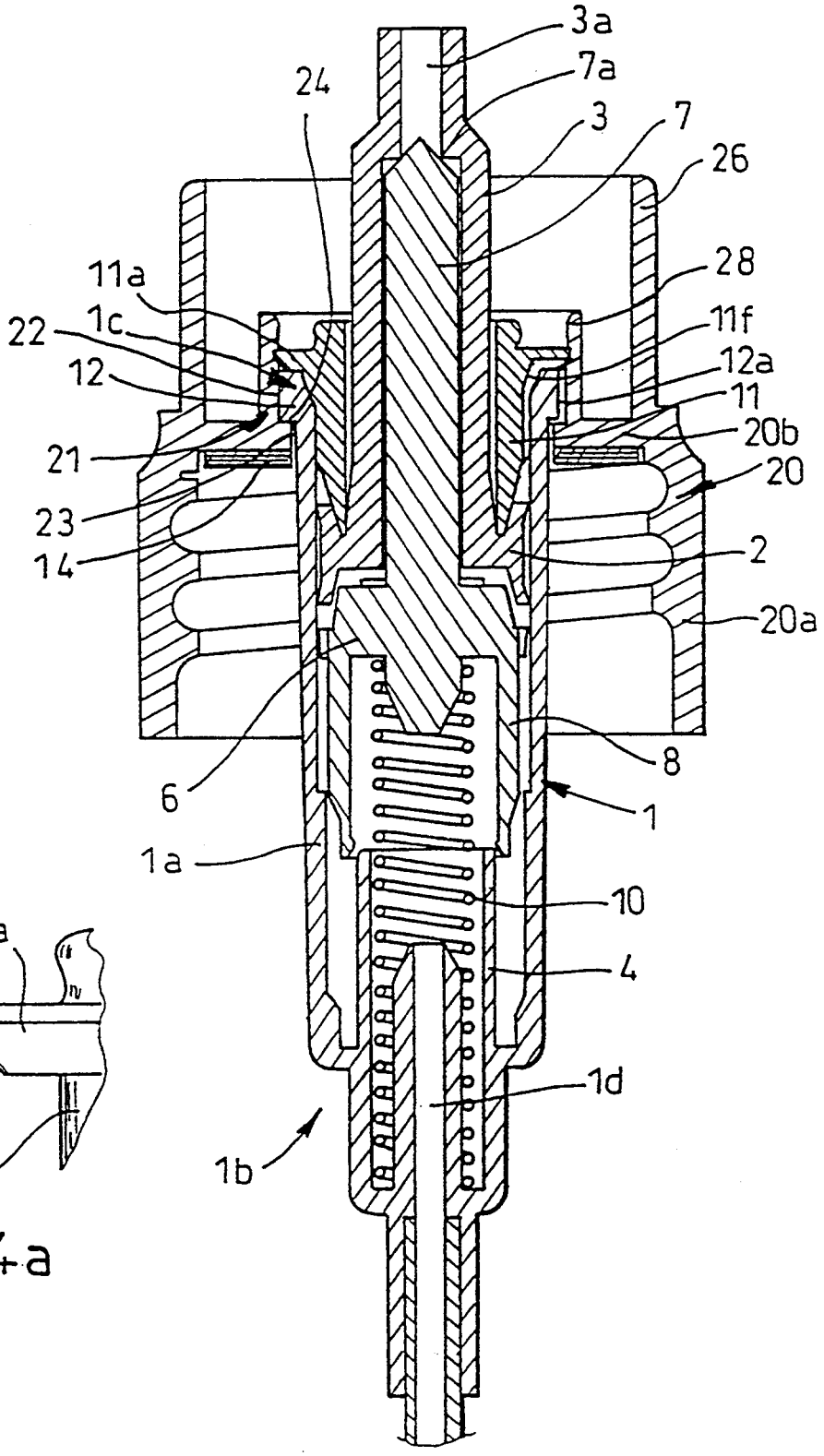
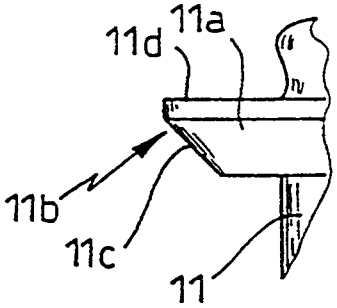
FIG. 4a

FLUID PUMP WITH SECURE MOUNTING TO RECEPTACLE STOPPER

The invention relates to an improvement in assembling a pump to a tank. The pumps in question are miniature pumps generally actuated by one finger of a hand for the purpose of dispensing or spraying a substance that is fluid, liquid, or semi-solid, such as a perfume, a cosmetic, or a pharmaceutical.

BACKGROUND OF THE INVENTION

More particularly, the invention relates to pumps comprising:

- a pump body having a sidewall extending axially between a first end which includes an inlet orifice and an open second end provided with an external collar;
- a piston that slides axially in said side wall, and a return spring that urges the piston towards the second end of the pump body; and
- a ferrule fixed in the second end of the side wall of the pump body to limit piston motion towards said second end.

There are several well known ways of fixing such a pump on the neck of a receptacle for said fluid substance to be dispensed or sprayed, or on a stopper suitable for being fixed on such a neck. Firstly, it is possible to crimp the pump on the neck of the receptacle by means of a metal cup. That method of assembly has the drawback of being relatively unattractive, and in addition a portion of the pump body necessarily projects above the neck of the receptacle, thereby tending slightly to increase the overall size of the device for dispensing the fluid substance.

It is also possible to use a part generally referred to as a "turret" which is secured to the ferrule of the pump body. Such a turret generally has a substantially cylindrical side wall that surrounds the pump body in the vicinity of the second end, said side wall of the turret being extended radially outwards by a tab that can be fixed to the neck of a receptacle by being clamped between a screw stopper and said neck of the receptacle. That assembly method suffers from the drawback that a substantial fraction of the pump body projects above the neck of the receptacle, thereby increasing the size of the device.

In addition, it is possible to use a screw stopper that includes a through axial inside passage, said passage including a substantially cylindrical first length towards the outside of the receptacle and a narrower second length towards the inside of the receptacle, said first and second lengths defining a shoulder facing towards the outside of the receptacle, the pump body being engaged in said second length and said collar being placed in abutment against the shoulder of the stopper, and said shoulder of the pump body being held in said second length of the stopper passage by an annular locking ring that is a force-fit inside the cylindrical lateral wall of the stopper. In that assembly, it is generally necessary to interpose a flat sealing gasket between the collar of the pump body and the locking ring. That method of fixing is advantageous insofar as the pump body projects a little above the neck of the tank. However it requires the use of a locking ring and of an additional sealing gasket.

OBJECTS AND SUMMARY OF THE INVENTION

An object of the present invention is to provide a way of assembling a pump on a stopper or on a receptacle neck that gives rise to bulk that is as small as in an assembly using a locking ring, but that is simpler and cheaper than said assembly by means of a locking ring.

The present invention provides a device for dispensing a fluid substance, the device including a pump mounted on a stopper designed to be fixed on a neck of a receptacle for said fluid substance, wherein:

- the pump includes a pump body extending axially between a first end that includes an inlet orifice and an open second end provided with an outside collar, the pump further including a piston that slides axially inside said pump body, and a return spring that urges the piston towards the open second end of the pump body, and the pump includes a ferrule constituted by a single piece fixed in said second end of the pump body to limit motion of the piston towards said second end;
- the stopper includes an axial internal passage passing therethrough, said passage including a substantially cylindrical first length towards the outside of the receptacle and a narrower second length towards the inside of the receptacle, said first and second lengths defining a shoulder facing towards the outside of the receptacle, said first length having an inside diameter that is substantially equal to the outside diameter of the collar on the pump body;
- the ferrule includes a flange which extends radially outwards;
- the pump body passes through the second length of the internal passage of the stopper, and the collar is disposed inside said first length of the internal passage of the stopper in abutment against the shoulder of the stopper; and
- wherein said flange of the ferrule has an outside diameter close to the outside diameter of said collar of the pump body and slightly greater than the inside diameter of the first length, and said flange is engaged as a force-fit inside said first length of the internal passage of the stopper to hold the pump in said stopper, preventing the pump body from moving towards the outside of the receptacle, both the ferrule and the stopper being made of plastics material, and the ferrule being made of a material that is harder than the stopper so that said radial flange bites into said stopper. Advantageously, said radial flange has at least one external catch with a sliding chamfered surface closer to the shoulder of the stopper and a stop surface further away from the shoulder of the stopper, so that said catch enables the flange to be put into place in the first length of the internal passage of the stopper and prevents said flange escaping from said first length of the internal passage of the stopper.

According to the present invention, a pump may be fixed on the neck of a receptacle in the manner described above providing the neck has the characteristics described above for the stopper. Advantageously, when the neck is made of metal, e.g. when the pump is fixed on a deformable aluminum tube, the said neck is upset after the pump has been assembled thereto so as to prevent said pump escaping from said neck.

BRIEF DESCRIPTION OF THE DRAWINGS

Other characteristics and advantages of the invention appear from the following description of an embodiment of the invention given by way of non-limiting example and described with reference to the accompanying drawings.

In the drawings:

FIG. 4 is a section view through a pump fixed on a screwable stopper in accordance with the present invention;

FIG. 4*a* is a detail view of FIG. 4;

MORE DETAILED DESCRIPTION

Figure 1:
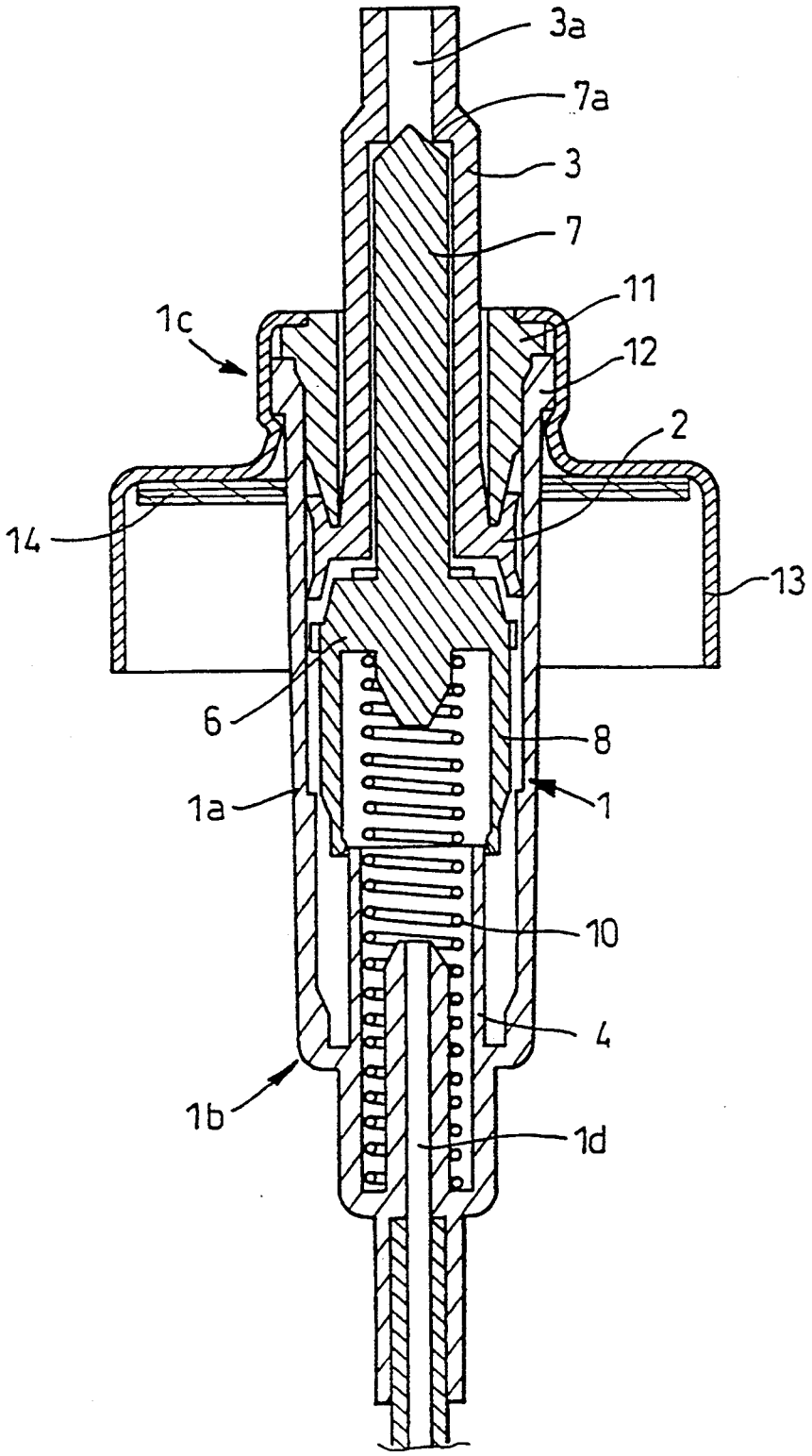
FIG.1 PRIOR ART
FIG. 1 is a section view through a pump provided with a prior art crimpable metal cup.

FIG. 1 shows a pump of the general type disclosed in Documents FR-A-2 305 241 and FR-A-2 314 772, and in corresponding U.S. Pat. No. 4,025,046. The pump shown comprises a pump body 1 provided with a cylindrical side wall 1*a* which extends between a first end 1*b* and a second end 1*c* of the pump body. The first end 1*b* has an end wall which includes an inlet orifice 1*d* of the pump, while the second end 1*c* is open and includes an external collar 12. A piston 2 is axially slidably mounted inside the pump body, the piston 2 being secured to a push rod 3 which passes through the first end 1*c* of the pump body. The push rod 3 is axially pierced by an outlet channel 3*a* which has a constriction 7*a*. A valve member 6 is also disposed inside the pump body and it includes a punch 7 engaged in the outlet channel 3*a*, together with a skirt 8 that extends axially towards the first end 1*b* of the pump body. The pump body further includes a tubular endpiece 4 which extends axial inside the side wall 1*a*, starting from the first end 1*b*. A spring 10 urges the valve member towards the second end 1*c* of the side wall 1 of the pump body, thereby tending to press the punch 7 in sealed manner against the constriction 7*a* of the outlet channel 3*a*, and tending to urge the piston 2 towards the end 1*c*. A cylindrical ferrule 11 is a force-fit or is snap-fastened or is otherwise fixed in the second end 1*c* so as to limit motion of the piston towards said second end 1*c*, thus defining a rest position for the pump. When the pump is in its rest position, the skirt 8 is not engaged on the endpiece 4. When the rod 3 is pressed into the inside of the pump body, the skirt 8 engages on the endpiece 4, thereby closing the inlet orifice 1*b*. When the pressure inside the pump body becomes sufficient, the punch 7 lifts off the constriction 7*a*, thereby enabling the measured volume of substance lying inside the pump body to escape via the outlet channel 3*a*.

In the example of FIG. 1, the pump is provided with a crimpable metal cup 13 suitable for crimping firstly on the collar 12 and the ferrule 11, and secondly on the neck of a receptacle (not shown) in conventional manner. Generally, a flat elastomer sealing ring 14 is interposed between the metal capsule 13 and the neck of a receptacle.

Figure 2:
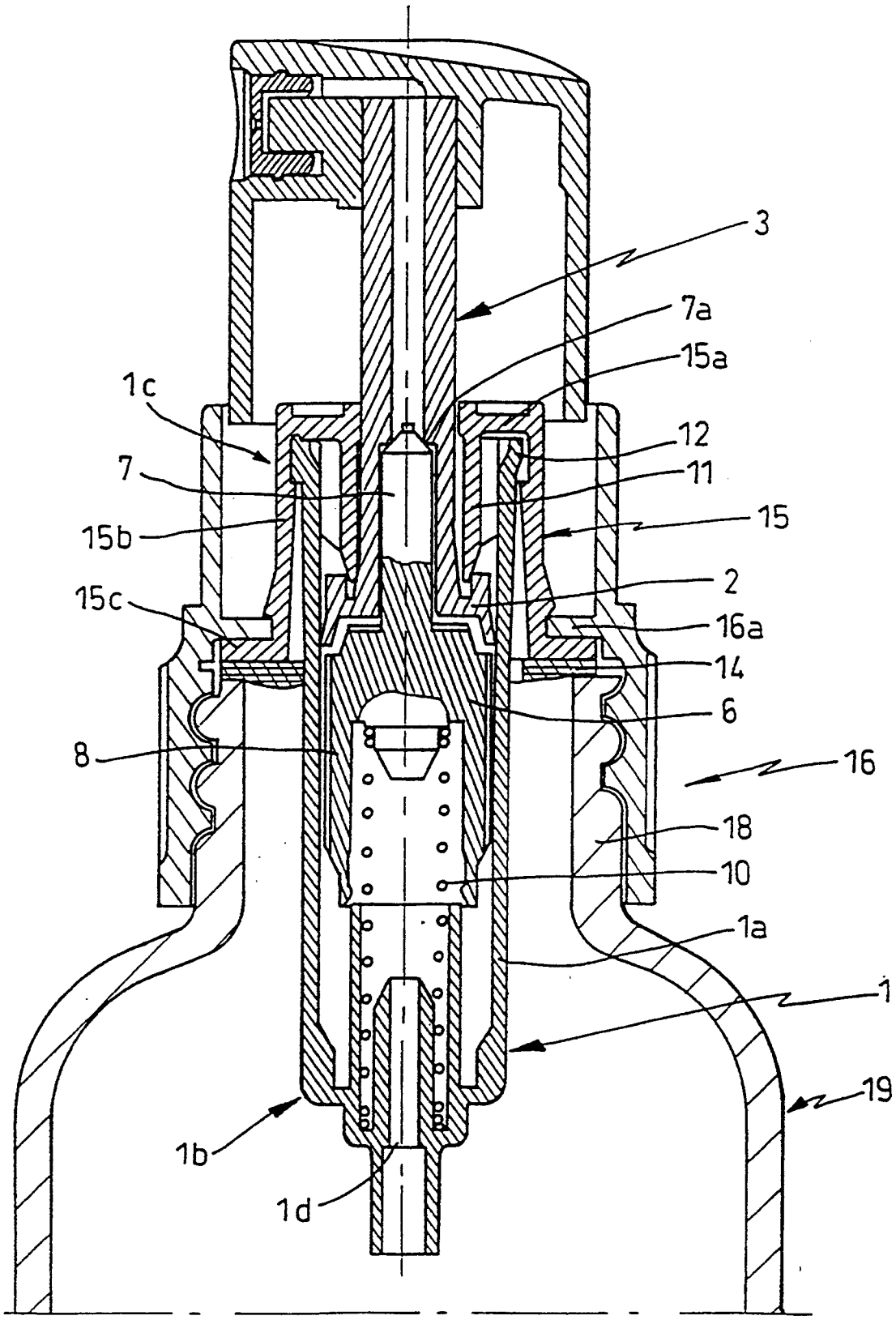
FIG. 2 PRIOR ART
FIG. 2 is a section view through a pump provided with a prior art fixing turret.

FIG. 2 shows another fixing method known in the prior art. The pump shown in FIG. 2 is similar to the pump of FIG. 1. It is fitted on a neck 18 of a receptacle 19 by means of a stopper 16 suitable for screwing onto said neck. The ferrule 11 of the pump is extended on the outside by a turret 15 which includes a first annular wall 15*a* extending radially outwards from the ferrule 11 to beyond the neck 12 of the pump body, said first annular wall 15*a* being extended axially towards the neck of the receptacle by a second annular side wall 15*b* that extends to a tab 15*c*. The stopper 16 includes an inside flange 16*a* that clamps the tab 15*c* against the neck 18 of the receptacle on assembly. Advantageously, a flat annular gasket 14 is interposed between the tab 15*c* and the neck 18.

Figure 3:
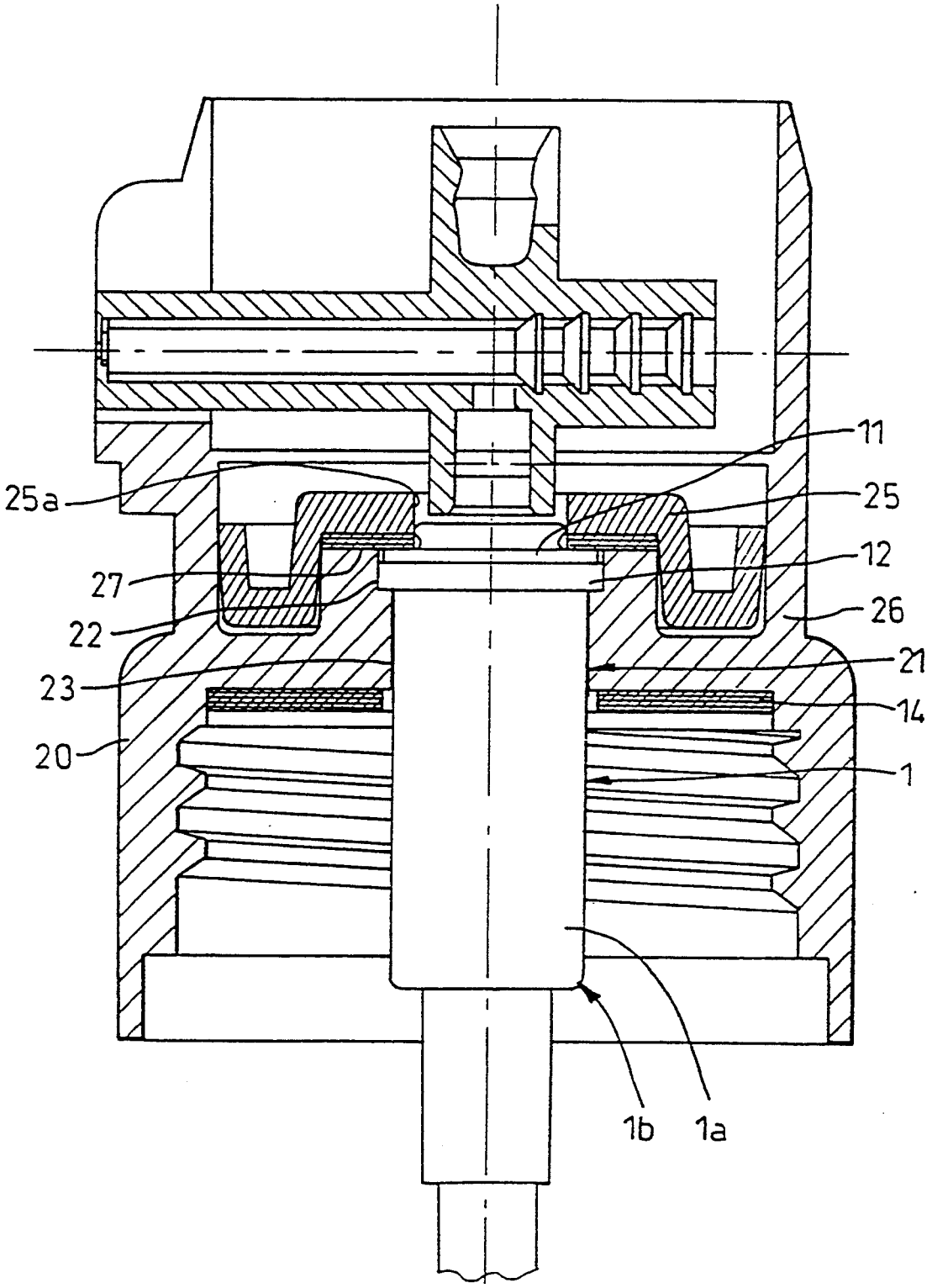
FIG.3 PRIOR ART
FIG. 3 is a fragmentary section view through a pump fixed on a stopper by means of a prior art locking ring.

As shown in FIG. 3, it is also known to assemble a pump body 1 on a stopper 20 suitable for screwing onto the neck of a receptacle by providing an axial passage 21 that passes through the inside of the stopper 20, said axial passage 21 including a cylindrical first length 22 that is further from the receptacle when the stopper is screwed onto the neck of the receptacle, and a narrower second length 23 that is closer to the receptacle when the stopper is screwed onto the receptacle. The first length 22 has a diameter that is substantially equal to the outside diameter of the collar 12 of the pump body. The inside passage 21 defines a shoulder 24 facing towards the outside of the receptacle. The collar 12 of the pump body lies inside the first length 22 of the inside passage 21 while the side wall 1*a* of the pump body is engaged inside the second length 23 of the inside passage 21 of the stopper. The collar 12 and the ferrule 11 of the pump are held in the first length 22 of the passage 21 by an annular locking ring 25. The stopper 20 includes an annular wall 26 formed around the inside passage 21 and extending axially away from the receptacle. The annular locking ring 25 is engaged as a force-fit inside the side wall 26 and said annular ring 25 has an axial central orifice 25*a* of diameter smaller than the diameter of the first length 22 of the inside passage 21 so as to hold the collar 12 of the pump body. A flat sealing ring 27 is disposed on the locking ring 25 so as to improve sealing between the locking ring on the one hand and the pump body and the stopper on the other hand.

FIG. 4 shows one implementation of the fixing method of the invention. The pump shown in FIG. 4 is identical to the pump shown in the preceding figures, but the invention is not limited to this particular kind of pump, the important point being that the pump includes a pump body provided at its top end with an outside collar and with a ferrule preventing the piston from escaping from the pump under drive from an internal return spring. The pump body is fixed on the neck of a receptacle (not shown) by means of a stopper 20. The stopper 20 includes a skirt 20*a* provided with an inside thread enabling the stopper to be screwed onto the neck of the receptacle. The stopper 20 also includes an internal annular flange 20*b* that extends radially inwards from the skirt 20*a* to a central orifice 22 whose diameter is substantially equal to or slightly greater than the outside diameter of the side wall 1*a* of the pump body, but is smaller than the outside diameter of the collar 12 of the pump body. A cylindrical side wall 28 extends axially from the flange 20*b* away from the receptacle, said side wall 28 surrounding the orifice 22. The inside diameter of the side wall 28 is substantially equal to the outside diameter of the collar 12. Thus, the orifice 22 and the side wall 28 define an axial inside passage that passes through the stopper, said passage including a first length 23 delimited by the side wall 28, and a second length 22 corresponding to the central orifice of the flange 20*b*. A shoulder 24 facing towards the outside of the receptacle is defined between the lengths 22 and 23. The stopper 20 also includes a cylindrical wall 26 extending axially away from the receptacle substantially in line with the skirt 20*a*. The side wall 26 is provided essentially for reasons of appearance, but it also serves to guide a pushbutton mounted on the rod 3 of the pump.

According to the invention, the ferrule 11 includes a radial flange 11*a* whose diameter is slightly greater than the inside diameter of the side wall 28. Thus, the radial flange 11*a* is a force-fit inside the side wall 28 and said flange 11*a* holds the pump body fixed in the stopper 20, locking the shoulder 12 inside the housing defined by the side wall 28 and the shoulder 24. Advantageously, as shown in FIG. 1, the flange 11*a* has an outer peripheral edge in the form of a catch 11*b* presenting a sliding chamfered surface 11*c* closer to the receptacle and a stop surface 11*d* further from the receptacle, and substantially perpendicular to the axis of revolution of the ferrule. Thus, when the pump body is installed in the stopper 20, the force-fit of the flange 11*a* inside the side wall 28 is made easier by the sliding surface 11*c*, and once the pump is in place, the flange 11*a* is prevented from escaping from the side wall 28 by the stop surface 11*d*. Advantageously, the ferrule 11 is made of a material that is harder than the side wall 28 so that the catch 11*b* can bite into the side wall 28, thereby making the assembly that much stronger. For example, the stopper 20 may be made of polypropylene while the ferrule 11 is made of acetal resin, which is harder.

In this way, the use of a locking ring such as that shown in FIG. 4 is avoided, and the use of a sealing ring interposed between said locking ring and the pump body is also avoided because the flange 11*a* provides sealing in this case against the side wall 28, thereby preventing any leakage of substance. In the example shown, the pump is of the type that operates with air intake, i.e. it sends air into the receptacle each time it is actuated. For this purpose, the ferrule 11 may be provided with an axial groove 11*f* and the collar 12 may include an axial groove 12*a* so as to enable the inside of the receptacle to communicate with the atmosphere while the pump is being actuated, as is well known in the state of the art. However, the fixing method shown in FIG. 4 is also applicable to pumps that operate without air intake, i.e. in the present case pumps that do not include the grooves 11*f* and 12*a*.

Figure 5:
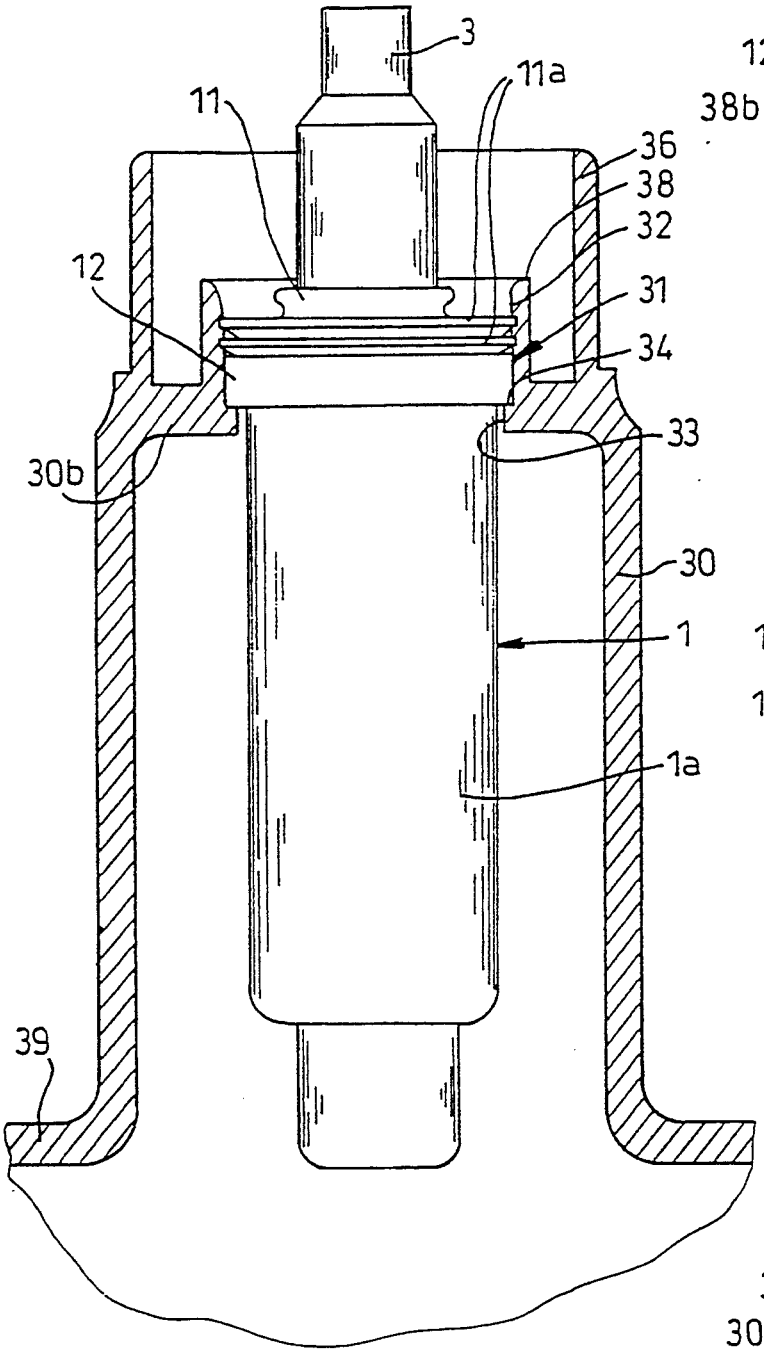
FIG. 5 is a fragmentary section view through a variant of the FIG. 4 device.

As shown in FIG. 5, it is not necessary to use a screw stopper in the fixing method of the invention. It is possible to use a receptacle having a neck 30 that is similar in shape to the stopper 20 described above. For example, as shown in FIG. 5, the receptacle 39 may be a tube that is deformable so as to be flattened progressively under the effect of suction from the pump and that includes a neck 30 provided with an inside annular flange 30*b* which extends radially inwards to a central orifice 33. The inside diameter of the central orifice 33 is substantially equal to or slightly greater than the outside diameter of the side wall 1*a* of the pump body. A cylindrical side wall 38 extends axially towards the outside of the receptacle from the flange 30*b*, surrounding the orifice 33. The cylindrical side wall 38 has an inside diameter substantially equal to the outside diameter of the collar 12. The wall 38 and the orifice 33 thus define an axial inside passage passing through the neck 30 having a first length 32 inside the side wall 38 and a second length 33 corresponding to the central orifice of the flange 30*b*. A shoulder 34 facing towards the outside of the receptacle is defined between the lengths 32 and 33. In the same manner as in the example of FIG. 4, the pump body is fixed inside the side wall 38 by means of two superposed radial flanges 11*a* on the ferrule 11, the outside diameter of the flanges being slightly greater than the inside diameter of the side wall 38, and the flanges are engaged as a force-fit inside the side wall 38.

Figure 8:
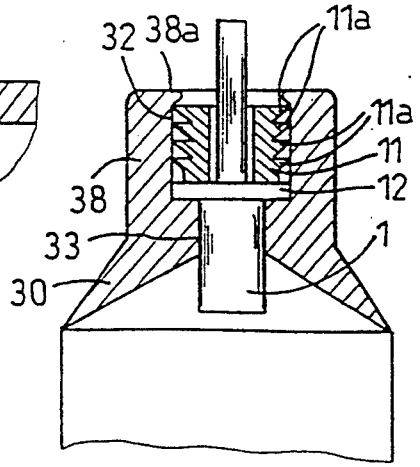
FIG. 8 is a section view through another variant of the device of the invention.

If the receptacle 39 is a deformable tube, it may be made of plastics material or optionally of a metal, e.g. aluminum. In which case, as shown in FIG. 8, the shape of the neck 30 will generally be simpler, the side wall 38 being generally thicker and the neck 30 not having a second side wall 36. Under such circumstances, it may be advantageous to upset the free end of the side wall 38 so as to form an inside rim 38*a* which prevents the pump body from escaping from said side wall 38.

Figure 6:
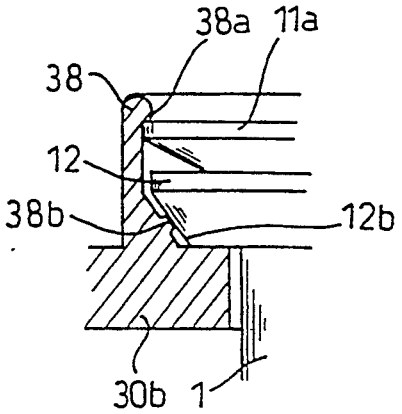
FIG. 6 is a detail view in fragmentary section showing another variant of the invention.

In a variant, as shown in FIG. 6, the flange 11*a* on the ferrule need not be a force-fit but may be snap-fastened inside the side wall 38, said side wall having an inside rim 38*a* for snap-fastening purposes. In addition, the side wall 38 may optionally include one or more sealing beads 38*b* which bear against the collar 12 of the pump body 1 when the pump operates without intake of air. In the example shown, the neck 12 is also in the form of a catch having a chamfered surface 12*b* closer to the tank, with the sealing bead 38*b* bearing against said chamfered surface 12*b*.

Figure 7:
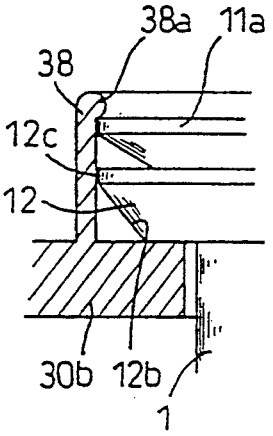
FIG. 7 is a view similar to FIG. 6 for another variant of the invention.

FIG. 7 shows a variant of FIG. 6 in which the collar 12 is likewise in the form of a catch having an outside edge 12*c* in sealing contact with the side wall 38.

I claim:

1. A device for dispensing a fluid substance, the device including a pump mounted on a stopper designed to be fixed on a neck of a receptacle for said fluid substance, wherein:

the pump includes a pump body extending axially between a first end that includes an inlet orifice and an open second end provided with an outside collar, the pump further including a piston that slides axially inside said pump body, and a return spring that urges the piston towards the open second end of the pump body, and the pump includes a ferrule constituted by a single piece fixed in said second end of the pump body to limit motion of the piston towards said second end;

the stopper includes an axial internal passage passing therethrough, said passage including a substantially cylindrical first length towards the outside of the receptacle and a narrower second length towards the inside of the receptacle, said first and second lengths defining a shoulder facing towards the outside of the receptacle, said first length having an inside diameter that is substantially equal to the outside diameter of the collar on the pump body;

the ferrule includes a flange which extends radially outwards;

the pump body passes through the second length of the internal passage of the stopper, and the collar is disposed inside said first length of the internal passage of the stopper in abutment against the shoulder of the stopper; and wherein said flange of the ferrule has an outside diameter close to the outside diameter of said collar of the pump body and slightly greater than the inside diameter of the first length, and said flange is engaged as a force-fit inside said first length of the internal passage of the stopper to hold the pump in said stopper, preventing the pump body from moving towards the outside of the receptacle, both the ferrule and the stopper being made of plastics material, and the ferrule being made of a material that is harder than the stopper so that said radial flange bites into said stopper.

2. A device according to claim 1, in which said radial flange has at least one external catch with a sliding chamfered surface closer to the shoulder of the stopper and a stop surface further away from the shoulder of the stopper, so that said catch enables the flange to be put into place in the first length of the internal passage of the stopper and prevents said flange escaping from said first length of the internal passage of the stopper.

3. A device according to claim 1, in which the pump operates without intake of air.

4. A device for dispensing a fluid substance, the device including a pump mounted on a neck of a receptacle for said fluid substance, wherein:

the pump includes a pump body extending axially between a first end that includes an inlet orifice and an open second end provided with an outside collar, the pump further including a piston that slides axially inside said pump body, and a return spring that urges the piston towards the open second end of the pump body, and the pump includes a ferrule constituted by a single piece fixed in said second end of the pump body to limit motion of the piston towards said second end;

the neck of the receptacle includes an axial internal passage passing therethrough, said passage including a substantially cylindrical first length towards the outside of the receptacle and a narrower second length towards the inside of the receptacle, said first and second lengths defining a shoulder facing towards the outside of the receptacle, said first length having an inside diameter that is substantially equal to the outside diameter of the collar on the pump body;

the ferrule includes a flange which extends radially outwards;

the pump body passes through the second length of the internal passage of the neck, and the collar is disposed inside said first length of the internal passage of the neck in abutment against the shoulder of the neck; and wherein said flange of the ferrule has an outside diameter close to the outside diameter of said collar of the pump body and slightly greater than the inside diameter of the first length, and said flange is engaged as a force-fit inside said first length of the internal passage of the neck to hold the pump in said neck, preventing the pump body from moving towards the outside of the receptacle, both the ferrule and the neck being made of plastics material, and the ferrule being made of a material that is harder than the neck so that said radial flange bites into said neck.

5. A device according to claim 4, in which said radial flange has at least one external catch with a sliding chamfered surface closer to the shoulder of the neck and a stop surface further away from the shoulder of the neck, so that said catch enables the flange to be put into place in the first length of the internal passage of the neck and prevents said flange escaping from said first length of the internal passage of the neck.

* * * * *